US011522279B1

(12) United States Patent
Krüger et al.

(10) Patent No.: US 11,522,279 B1
(45) Date of Patent: Dec. 6, 2022

(54) RADOME WITH INTEGRATED ANTENNA ARRAY AND ANTENNA ASSEMBLY HAVING THE SAME

(71) Applicant: XILINX, INC., San Jose, CA (US)

(72) Inventors: René Krüger, Dresden (DE); Jörg Reins, Dresden (DE)

(73) Assignee: XILINX, INC., San Jose, CA (US)

( * ) Notice: Subject to any disclaimer, the term of this patent is extended or adjusted under 35 U.S.C. 154(b) by 0 days.

(21) Appl. No.: 16/894,404

(22) Filed: Jun. 5, 2020

(51) Int. Cl.

| | |
|---|---|
| ***H01Q 1/42*** | (2006.01) |
| ***H01Q 21/00*** | (2006.01) |
| ***H01Q 1/02*** | (2006.01) |
| ***H01Q 21/06*** | (2006.01) |

(52) U.S. Cl.
CPC ..... *H01Q 1/42* (2013.01); *H01Q 1/02* (2013.01); *H01Q 21/0025* (2013.01); *H01Q 21/0087* (2013.01); *H01Q 21/061* (2013.01)

(58) Field of Classification Search
CPC ..... H01Q 1/42; H01Q 1/02; H01Q 21/0025
USPC ..... 343/872
See application file for complete search history.

(56) References Cited

U.S. PATENT DOCUMENTS

| | | | | |
|---|---|---|---|---|
| 9,325,061 | B2 | 4/2016 | Rucki et al. | |
| 10,313,894 | B1 * | 6/2019 | Desclos | H04W 16/28 |
| 10,424,842 | B2 * | 9/2019 | Davies | H01Q 19/10 |
| 10,557,934 | B1 * | 2/2020 | Billsberry | G01S 13/32 |
| 2004/0150561 | A1 | 8/2004 | Tillery et al. | |
| 2006/0145931 | A1 * | 7/2006 | Ranta | H01Q 1/38 343/702 |
| 2012/0223862 | A1 * | 9/2012 | Kerselaers | H01Q 1/3275 343/700 MS |
| 2014/0118196 | A1 * | 5/2014 | Koskiniemi | H01Q 21/205 343/702 |
| 2014/0184468 | A1 * | 7/2014 | Fitch | H01Q 1/42 343/872 |
| 2015/0303586 | A1 | 10/2015 | Hafenrichter et al. | |
| 2018/0231657 | A1 * | 8/2018 | Woehlte | H01Q 1/3233 |
| 2019/0268046 | A1 * | 8/2019 | Kim | H01Q 21/28 |
| 2021/0313686 | A1 * | 10/2021 | Rojanski | H01Q 1/286 |

FOREIGN PATENT DOCUMENTS

| | | | |
|---|---|---|---|
| EP | 3565057 | A1 | 11/2019 |

* cited by examiner

*Primary Examiner* — Peguy Jean Pierre
(74) *Attorney, Agent, or Firm* — Patterson + Sheridan, LLP

(57) ABSTRACT

A radome having an integrated antenna array and an antenna assembly having the same are described herein. A method for fabricating a radome having an integrated antenna array is also described herein. In one example, a radome is provided that includes a radome shell and an antenna array. The antenna array has a radiating surface and a backside surface. The radome shell is affixed to the antenna array forming an independent unitary structure separable from other components of an antenna assembly.

17 Claims, 4 Drawing Sheets

RADOME WITH INTEGRATED ANTENNA ARRAY AND ANTENNA ASSEMBLY HAVING THE SAME

TECHNICAL FIELD

Embodiments of the present invention generally relate to a radome with an integrated antenna array and radome shell, and an antenna assembly having the same.

BACKGROUND

Radomes are commonly utilized in antenna assemblies to protect the interior components such as antenna arrays and control circuitry from the elements. Typically, radomes are fabricated from a polymer or glass reinforce plastic that is sufficiently transparent to signals broadcast and received by the antenna array, while being suitable for outdoor use. One challenge in designing an effective radome is to make the radome sufficiently resistant to wind loads without becoming overly large, thick, and expensive.

In many next generation antenna assemblies, requirements for the size and weight of antenna assemblies are coming smaller and smaller, consequently pressuring designers to reduce the size and weight of the radome. As a result, light weight radomes are becoming more susceptible to deflection under high wind loads, which undesirably results in a deflection of the signals passing though the radome. The deflection of the signals passing though the radome may undesirably result on loss of signal coverage in certain areas serviced by the antenna assembly.

Therefore, a need exists for an improved radome and antenna assembly having the same.

SUMMARY

A radome having an integrated antenna array and an antenna assembly having the same are described herein. A method for fabricating a radome having an integrated antenna array is also described herein. In one example, a radome is provided that includes a radome shell and an antenna array. The antenna array has a radiating surface and a backside surface. The radome shell is affixed to the antenna array forming an independent unitary structure separable from other components of an antenna assembly.

In another example, an antenna assembly is provided that includes a chassis, an antenna circuit board, and a radome. The radome is coupled to the chassis and encloses the antenna circuit board within the chassis. The radome is separable from the chassis as an independent unitary structure. The radome includes an antenna array having a radiating surface and a backside surface, and a radome shell affixed to the radiating surface of the antenna array.

In yet another example, a method of fabricating a radome is provided. The method includes contacting a radiating surface of an antenna array with a radome material suitable for use as a radome, and forming a radome comprising a unitary structure that includes the antenna array and the radome material.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements of one embodiment may be beneficially incorporated in other embodiments.

DETAILED DESCRIPTION

A radome and an antenna assembly having the same are described below that utilize an antenna array integrated with a shell to form a unitary radome structure. The radome with unitary shell and antenna array enables the antenna assembly to advantageously be more compact in size as compared to conventional antenna assembles. Additionally, the unitary radome is stiffer than comparably sized conventional antenna assembles, thereby having reduced deflection when exposed to high wind loading. Advantageously, the reduced susceptibility to deflection consequently provides robust and reliable signal coverage. Furthermore, due to the complete sealing of the antenna layer, optional heat sinks may be employed directly below the antenna array to improve thermal management of the active components and circuits of the antenna circuit board, thus improving the weight related to the cooling performance, make the cooling simpler and improving the service life.

Figure 1:
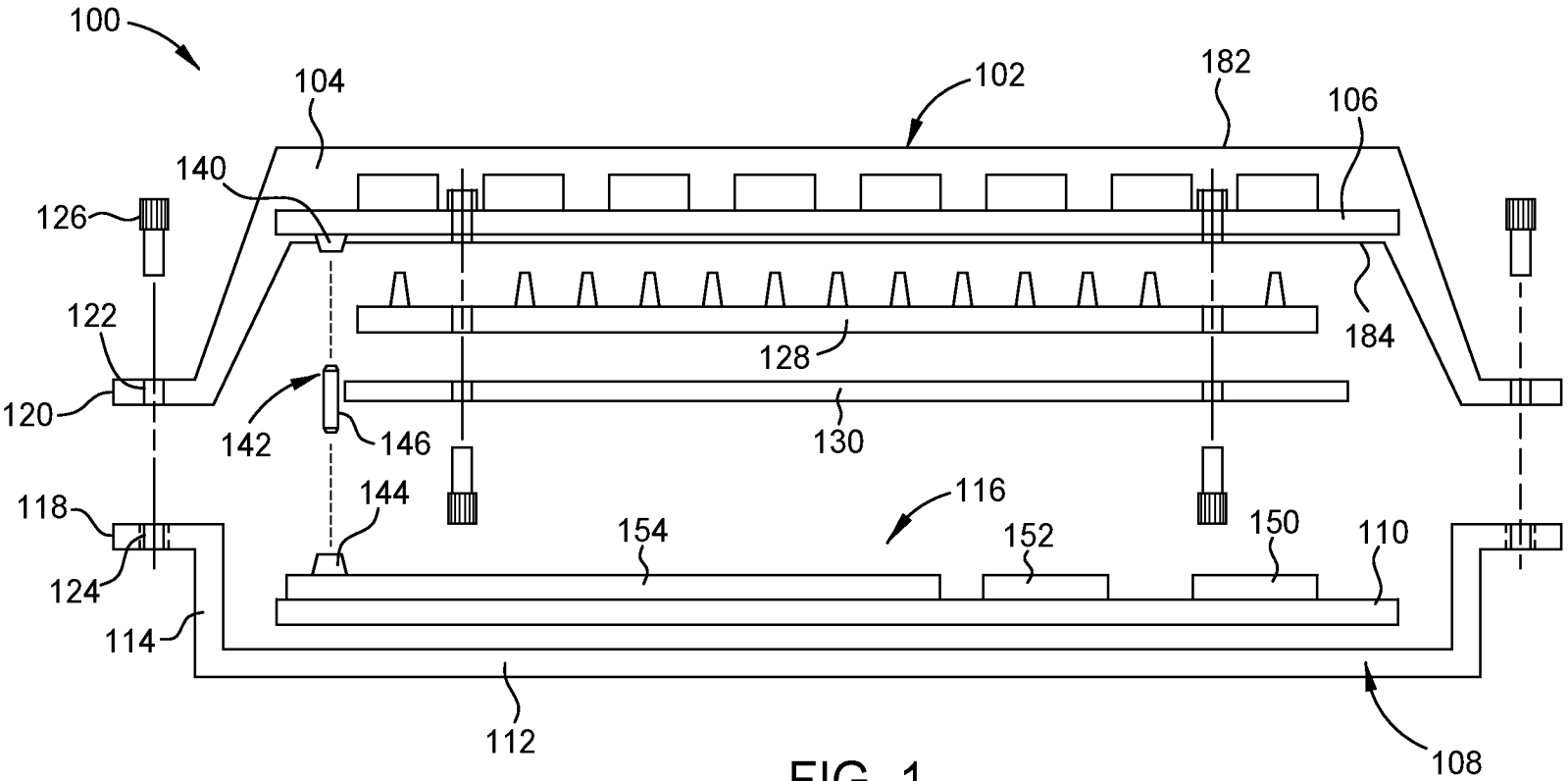
FIG. 1 is an exploded schematic sectional view of an antenna assembly having a radome with integrated antenna array and shell.

Turning now to FIG. 1, an exploded schematic sectional view of an antenna assembly 100 having a radome 102 is illustrated. The radome 102 has a shell 104 and an antenna array 106 integrated together as an unitary radome structure. The radome 102 includes an exterior surface 182 and an interior surface 184, the exterior surface 182 providing the weather protection for the antenna assembly 100. The antenna assembly 100 also includes a chassis 108 and an antenna circuit board 110. The antenna circuit board 110 is disposed in the chassis 108. The radome 102 is coupled to the chassis 108 and with the chassis 108, encloses the antenna circuit board 110 to protect the antenna circuit board 110 from the elements (i.e., environment) exterior to the antenna assembly 100. The antenna array 106 is also enclosed by the radome 102 and the chassis 108, and thus protected from the outside environment.

The shell 104 and the antenna array 106 are integrated into the radome 102 as a single, unitary assembly that is separable, as a unit, from the other components of the antenna assembly 100. Details of the unitary construction of the shell 104 and the antenna array 106 are described further below with reference to FIG. 3. Continuing to refer to FIG. 1, the antenna array 106 includes a plurality of connectors 140, each of which are configured to couple with one end of an RF connector 142. The RF connector 142 may be a coaxial cable or other suitable board-to-board connector. In the example depicted in FIG. 1, the RF connector 142 is a bullet adapter 146, such as available from Amphenol RF, that configured to couple with a plurality of connectors 144 of the antenna circuit board 110. The bullet adapter 146 allows the radome 102 to be assembled and mounted to the chassis 108 while providing tolerance for good and reliable communication between the antenna circuit board 110 and the antenna array 106 through the RF connector 142.

The radome 102 may optionally include a heat sink 128 and an RF shield 130. Although both the heat sink 128 and the RF shield 130 are illustrated in FIG. 1, generally only one is utilized. The heat sink 128 may be disposed between the antenna circuit board 110 and the antenna array 106 of the radome 102 without being coupled to the radome 102 itself.

The heat sink 128 is generally fabricated from thermally conductive material, such as aluminum, copper or other suitable metal. The heat sink 128 may include fins. The heat sink 128 may optionally include conduits for flowing a heat transfer fluid to enhance the removal of heat from within the antenna assembly 100. The fins of the heat sink 128 face the antenna array 106 so that the heat sink 128 may more effectively remove heat from the antenna circuit board 110. The heat sink 128 may also be configured to function as a RF shield. The heat sink 128 may optionally include grooves or other surface features in conjunction with a thermal interface material (TIM) to increase the rate of heat transfer between the heat sink 128 and the components of the antenna circuit board 110.

When a heat shield is not utilized, the RF shield 130 may be disposed between the antenna circuit board 110 and the antenna array 106 of the radome 102. The RF shield 130 is configured to reduce or block the transfer of radio frequency electromagnetic radiation between the antenna assembly 100 and the antenna circuit board 110. The RF shield 130 is fabricated from conductive or magnetic materials to form a Faraday cage. Although not shown, the RF shield 130 is coupled via a conductor to the ground of the chassis 108.

The chassis 108 is generally fabricated from a metal or plastic. In one example, the chassis 108 is fabricated from a die cast metal, such as aluminum, magnesium or zinc alloys. The chassis 108 may be coated or anodized. For example, the chassis 108 may have an epoxy power coat. The chassis 108 may also optionally include cooling fin structures disposed on it interior and/or interior surfaces to facilitate distribution of heat from sources at 110, 150, 152 and 154.

The chassis 108 has a bottom 112 and sides walls 114 that define a hollow interior 116. The chassis 108 is configured to mate with the radome 102 so as to enclose the hollow interior 116 and shield the components of the antenna assembly 100 from the elements. The radome 102 is generally removably secured to the chassis 108 to allow access to the hollow interior 116 so that the antenna circuit board 110 and/or other components of the antenna assembly 100 may be serviced. In the example depicted in FIG. 1, the sides walls 114 of the chassis 108 include an outwardly turned lip 118 that mates with a complimentary outwardly turned lip 120 of the radome 102. One of the lips 118, 120 includes a through hole 122 that is aligned with a threaded hole 124 of the other one of the lips 118, 120. A plurality of fasteners 126 are utilized to secure the radome 102 to the chassis 108. For example, fasteners 126 are illustrated in FIG. 1 passing through the through hole 122 of the radome 102 and threaded into the threaded hole 124 of the chassis 108 to secure the radome 102 to the chassis 108. Although not shown in FIG. 1, a gasket or other seal may be utilized between the radome 102 and the chassis 108 to provide a weather-resistant seal therebetween as the radome 102 is secured over the chassis 108. It is also contemplated that the radome 102 may be secured to the chassis 108 by using alternative techniques, such as a metal clamp, latch or other suitable device.

The hollow interior 116 is configured to receive the antenna circuit board 110. The antenna circuit board 110 is fastened or otherwise secured to the chassis 108, for example by fasteners, not shown, or other suitable technique. The antenna circuit board 110 generally includes the connectors 144, passive circuit components (not shown), control circuitry 150, a power supply 152, and an array of transceivers 154.

Figure 2:
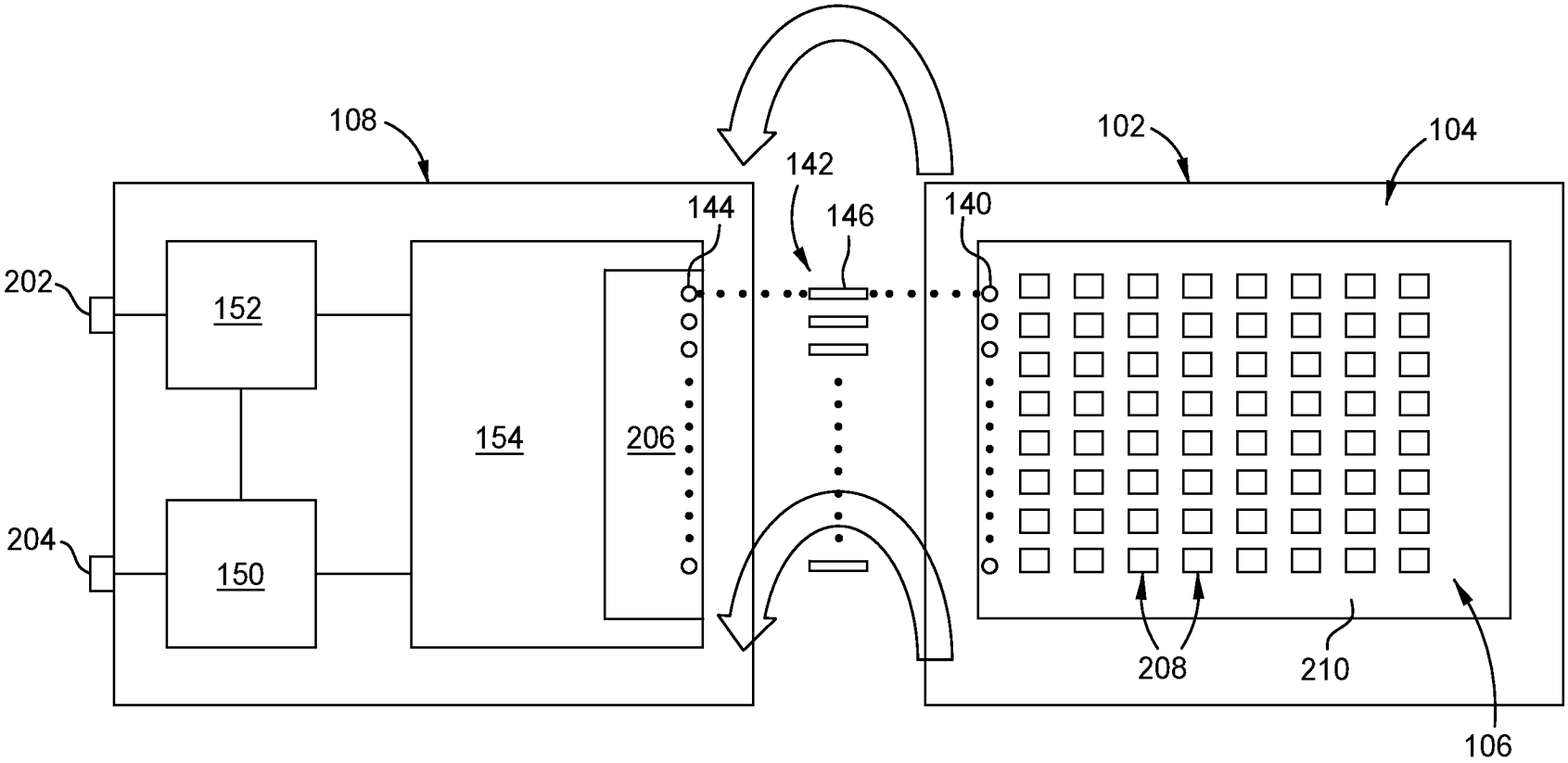
FIG. 2 is a schematic block diagram of the antenna assembly illustrating the radome having the antenna array and shell integrated as a unitary structure that is separable from the other components, such as a chassis, of the antenna array.

Referring now to the schematic block diagram of FIG. 2, the control circuitry 150 is coupled to the power supply 152 and to the transceiver 154. The control circuitry 150 is also coupled to one or more data ports 204. The data ports 204 enable the antenna assembly 100 to communicate with an external electronic device, such as a base band unit of a cell site. The control circuitry 150 includes processors or other digital logic for processing signals that may be produced and/or received by the antenna array 106.

The power supply 152 is similarly coupled to the control circuitry 150 and to the transceiver 154. The power supply 152 is also coupled to one or more power ports 202. The power ports 202 allow the antenna assembly 100 to received power from an external power source, such as a generator or the electrical grid.

The transceivers 154 are coupled to the power supply 152, the control circuitry 150 and the antenna array 106 of the radome 102. The transceivers 154 include at least one or more of digital-to-analog converters (DAC), analog-to-digital converters (ADC), filters, modulators and high-performance RF front ends 206. The RF front ends 206 include the plurality of connectors 140 that facilitate coupling, via RF connectors 142, to the connectors 144 of individual radiating elements 208 of the antenna array 106. Each radiating element 208 is disposed on a substrate 210 and coupled to a respective one of the RF front ends 206 via a separate RF connector 142. The substrate 210 is generally a non-conductive plate, such as glass reinforced plastic or other suitable material having at least two copper layers for signal traces and reference planes.

As illustrated in FIG. 2, the RF connectors 142 allow the radome 102 to be easily mounted to the chassis 108 and sealingly enclose the antenna array 106 and the antenna circuit board 110, along with the heat sink 128 and RF shield 130 when present, within the hollow interior 116 of the antenna assembly 100, while providing reliable high tolerance signal transmission between the antenna array 106 and the antenna circuit board 110.

Figure 3:
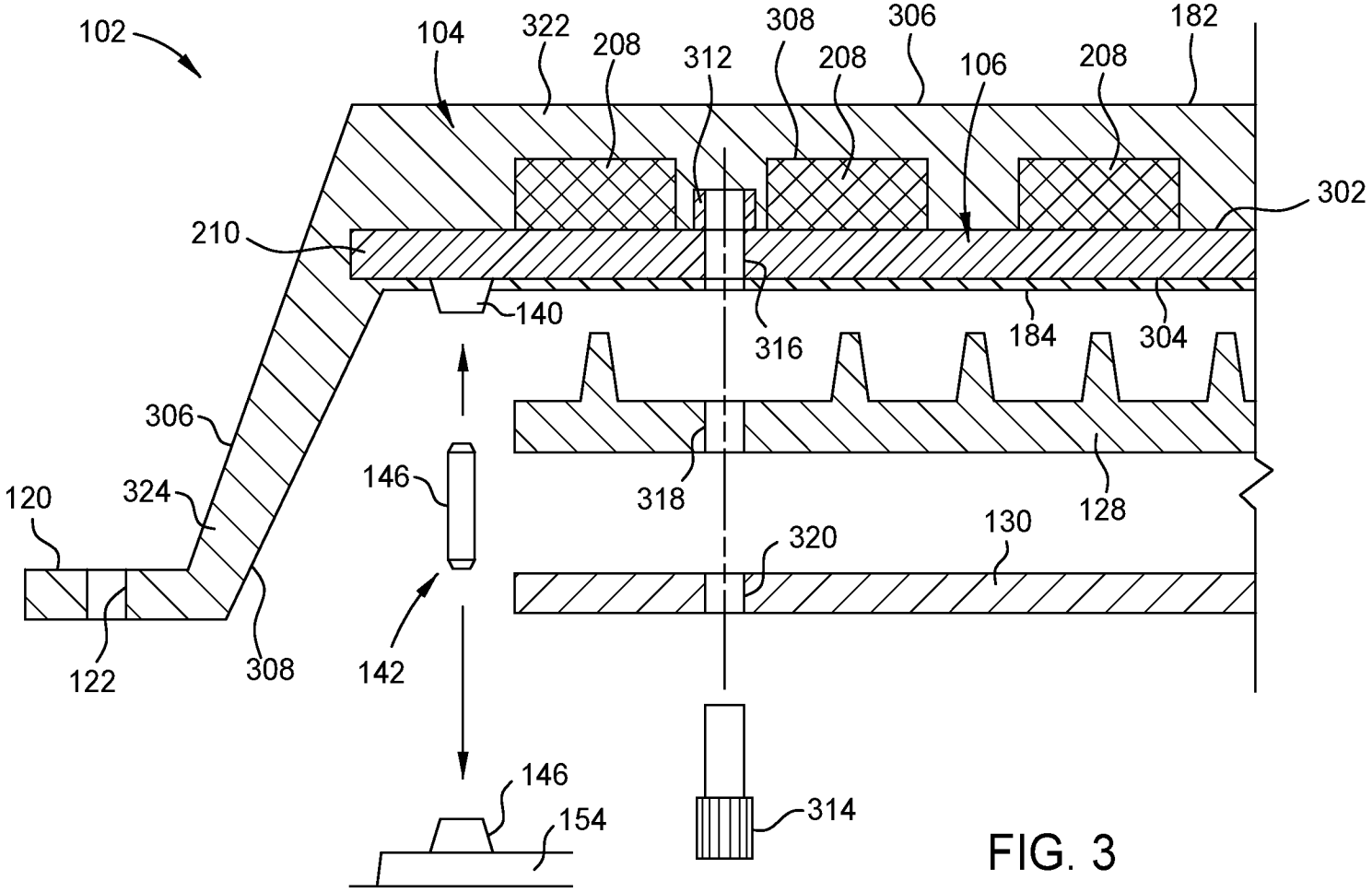
FIG. 3 is an enlarged partial sectional view of the radome of FIG. 1.

FIG. 3 is an enlarged partial sectional view of the radome 102 illustrating the shell 104 and the antenna array 106 integrated as a single unit. In FIG. 3, a portion of the shell 104 is shown cut away to expose the antenna array 106. The antenna array 106 generally includes a radiating surface 302 and a backside surface 304. The radiating surface 302 and the backside surface 304 are also the front and back surfaces of the substrate 210. The backside surface 304 generally faces the antenna circuit board 110.

The backside surface 304 also may be in contact with the heat sink 128, when present. In the example depicted in FIG. 3, one or more threaded inserts 312 and fasteners 314 are utilized secure the heat sink 128 or the RF shield 130 to the antenna array 106, and consequently, the radome 102 when utilized. The threaded insert 312 is secured to the substrate 210 or otherwise positioned on the backside surface 304 of the antenna array 106. The threaded insert 312 is aligned with a through hole 316 formed through the substrate 310. The through hole 316 is also aligned with holes 318 formed through the heat sink 128. The fastener 314 passes through the holes 316, 318 and is threaded into the threaded insert 312, thus securing the heat sink 128 to the backside surface 304 of the antenna array 106. Alternatively when the RF shield 130 is utilized without a heat sink, and the through hole 316 is also aligned with holes 320 formed through the RF shield 130. The fastener 314 passes through the holes 316, 320 and is threaded into the threaded insert 312, thus securing the RF shield 130 to the backside surface 304 of the antenna array 106. Alternatively, the fastener 314 may be inserted through the antenna array and threaded into one of the heat sink 128 or RF shield 130. In this manner, the heat sink 128 (or the RF shield 130) becomes part of the integrated radome structure that is independently removable from the chassis 108 as a single assembly of components.

The radiating surface 302 has the radiating elements 208 mounted thereon. Stated differently, the radiating elements 208 are mounted to the front surface of the substrate 310. In one example, radiating elements 208 are arranged in an 8×8 array on the radiating surface 302. The radiating elements 208 may alternatively different in number and/or arrangement. The radiating element 208 is generally a metal patch configured to communicate signals on a wireless or mobile network, such as 4G and 5G networks. In one example, the radiating elements 208 are arranged to form a phased array of beam-forming antenna elements.

Each or a combination of the radiating elements 208 is connected to a separate one of the connectors 140, for example by a metal trace or other conductor. The connectors 140 may be mounted to the backside surface 304 of the antenna array 106 (i.e., the back surface of the substrate 210).

The shell 104 includes an exterior surface 306 and an interior surface 308. The exterior surface 306 of the shell 104 faces the environment outside of the antenna assembly 100, and thus also is part of the exterior surface 182 of the radome 104. The shell 104 is formed over the antenna array 106 such that portion of the interior surface 308 directly contacts the radiating elements 208. In one example, the shell 104 molded or laminated over the antenna array 106. Suitable molding techniques include, but are not limited to, injection molding, vacuum molding, insert molding, over molding, casting and potting. The shell 104 may be alternatively laminated over the antenna array 106 using conventional fiberglass lay-up techniques. In one example, the radome material forming the shell 104 encapsulates the antenna array 106 such that the antenna array 106 is inlayed inside the shell 104. The strip of radome material of the shell 104 defined between the backside surface 304 of the antenna array 106 and inside surface 184 of the radome 104 provides additional stiffness and weather protection. Molding or laminating the shell 104 directly over the antenna array 106 advantageously increases the rigidity of both the shell 104 and the antenna array 106, while also advantageously decreasing the amount of material needed to fabricate the shell 104. With less shell material above the antenna array 106, the radome 102, and consequently the antenna assembly 100, desirably has a slimmer and reduced profile that not only is aesthetically pleasing, but also advantageously is less susceptible to wind loading. The enhanced rigidity of the unitary shell 104 and antenna array 106, e.g., the radome 102, beneficially improves resistance to wind loading and deflection, thus resulting in robust reliability and performance of the antenna assembly 100.

The stiffness of the radome 102 is also enhance by the conformal contact between the interior surface 308 of the shell 104 to the varied elevation resulting from the projection of the radiating elements 208 above the front surface of the substrate 310. As the material of the shell 104 conformally contacts and adheres to the top and sides of the radiating elements 208, along with the portions of the radiating surface 302 exposed between and adjacent to the radiating elements 208, the stiffness of the shell 104 is significantly great than flat surfaces of conventional radomes. Stiffness is further enhanced encapsulating the antenna array 106 within the material of the radome shell 104. Moreover, the increased stiffness of the radome 102 is achieved without the use of ribs or other structures that would result in a larger radome, which undesirably increases wind loads that need to be accounted for through more costly designs. The radome 102 may further be stiffened by securing one of the heat sink 128 or RF shield 130 to the bottom interior surface 184 of the shell 130. Since the radome 102 is inherently stiff and less prone to deflection, the probability of loss of signal coverage in certain areas serviced by the antenna assembly 100 is greatly reduced, resulting in a robust performance and reliability over the life of the antenna assembly 100.

The material comprising the shell 104 is generally suitable for outdoor use and has a suitable radio frequency (RF) transmission properties, while providing sufficient structural rigidity to inhibit excessive deflection due to wind loading. Suitable materials include, but are not limited to, glass reinforced plastics, thermoplastic compounds, fiberglass, and UV stabilized plastics, such as outdoor grade polyvinyl chloride (PVC). In one example, the material comprising the shell 104 is an injection moldable polymer.

The shell 104 generally includes a face 322 and side walls 324. The face 322 is disposed over the radiating elements 208, while the side walls 324 extend away from the face 322 and project beyond the backside surface 304 of the antenna array 106. The side walls 324 terminate at the lips 118.

Figure 4:
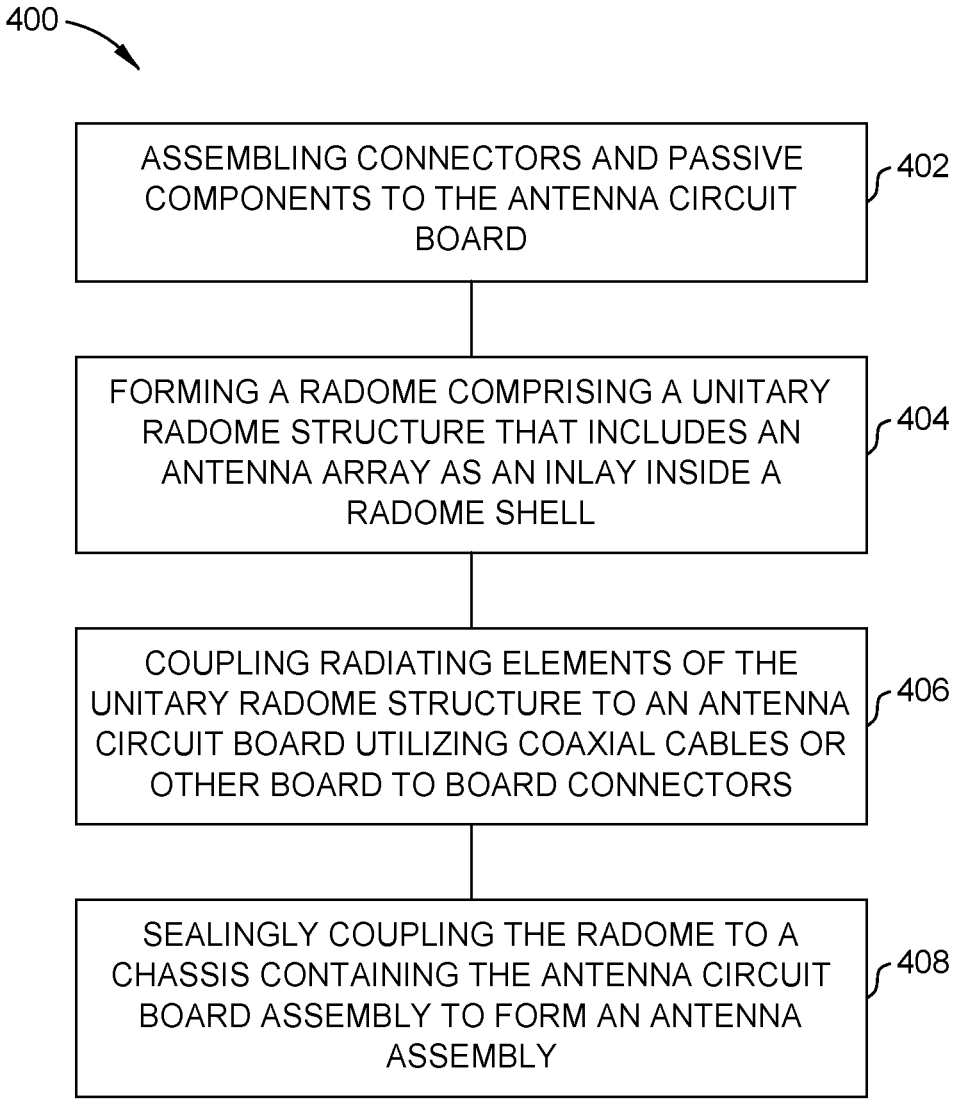
FIG. 4 is a flow diagram of a method for fabricating an antenna assembly.

FIG. 4 is a flow diagram of a method 400 for fabricating an antenna assembly, such as the antenna assembly 100 among others. The method 400 begins at operation 402 by assembling the connectors 144, passive circuit components (not shown), control circuitry 150, a power supply 152, and a transceiver 154 to the antenna circuit board 110.

At operation 404, a radome is formed comprising a unitary single piece structure that includes an antenna array and radome material. For example, the molding or laminating of the antenna array to the radome material forming a shell results in a single piece unitary structure that cannot be separated without breaking the adhesion between the antenna array and shell. Operation 404 includes contacting a radiating surface of the antenna array with a radome material suitable for use as a radome. In one example, radome material is conformally molded over the radiating surface of the antenna array, such as by injection molding, vacuum molding, insert molding, over molding, casting or potting. In another example, radome material is laid conformally over the radiating surface of the antenna array by laminating layers of glass reinforced plastic, fiberglass or other suitable material conformally on the antenna array. In this manner, the radome material conformally contacts and adheres to the sides and top surface of the radiating elements of the antenna array, along with portions of the radiating surface that are exposed between the radiating elements. In other examples such as depicted in FIG. 1, the radome material encapsulates the antenna array such that the antenna array is inlayed inside the shell with only the connectors exposed. The conformal contact and adhesion to a non-planar interface provided by the radiating elements dispersed along the top and bottom surfaces of substrate results in a very stiff unitary radome structure as compared to conventional radome designs.

Operation 404 may also include securing a heat sink and/or an RF shield to a back surface of the antenna array. The heat sink and/or an RF shield may be secured to a backside surface of the antenna array by fasteners or other suitable technique. In one example, one or both of the heat sink and an RF shield is secured to the antenna array utilizing the radome material, for example, as part of the molding or laminating process described above, and thus becoming are of the unitary radome structure.

At operation 406, the radiating elements, now part of the unitary radome comprising the shell and the antenna array, are coupled to an antenna circuit board utilizing RF connectors. The antenna circuit board may be disposed in a chassis of the antenna assembly prior to or after coupling the antenna circuit board to the antenna array. At operation 408, the radome is sealingly coupled to the chassis to form the completed antenna assembly.

Thus, a radome and antenna assembly having the same have been described which utilize a unitary radome structure that results in the completed antenna assembly having a slim profile. The slim profile of the antenna array and radome shell one piece unitary assembly comprising the radome desirably reduces wind load and cost as compared to conventions radome designs. The unitary radome structure provides enhanced the resistance to deflection which greatly improves the reliability and performance of the antenna assembly.

While the foregoing is directed to embodiments of the present invention, other and further embodiments of the invention may be devised without departing from the basic scope thereof, and the scope thereof is determined by the claims that follow.

What is claimed is:

1. An antenna assembly comprising:

a chassis;

an antenna circuit board disposed in the chassis, the antenna circuit board having transceivers;

a radome coupled to the chassis and enclosing the antenna circuit board within the chassis, the radome separable from the chassis as an independent unitary structure, the radome comprising:

an antenna array having a radiating surface and a backside surface; and a radome shell encapsulating the antenna array wherein the radome shell is molded with the antenna array to form the unitary structure; and RF connectors coupling the radiating surface of the antenna array to the transceivers of the antenna circuit board; and a radio frequency (RF) shield coupled to the backside surface of the antenna array.

2. The antenna assembly of claim 1, wherein the radome shell comprises of a material selected from the group consisting of outdoor grade plastics, glass reinforced plastic and fiberglass.

3. The antenna assembly of claim 1, wherein the antenna array further comprises:

a plurality of radiating elements disposed on the radiating surface in direct contact with the radome shell.

4. The antenna assembly of claim 1, wherein the radome shell is conformally in contact with the radiating surface of the antenna array.

5. The antenna assembly of claim 1, wherein the radiating surface of the antenna array comprises:

a plurality of projecting radiating elements, the plurality of projecting radiating elements arranged to form a phased array of beam-forming antenna elements.

6. The antenna assembly of claim 5, wherein the radome shell is conformally molded over sides and tops of the radiating elements projecting from radiating surface of the antenna array.

7. The antenna assembly of claim 1, wherein the backside surface of the antenna array not encapsulated by the radome shell.

8. The antenna assembly of claim 5, wherein the plurality of radiating elements of the antenna array in an 8×8 array.

9. A radome comprising:

an antenna array having a radiating surface and a backside surface, the radiating surface having a plurality of projecting radiating elements, the plurality of projecting radiating elements arranged to form a phased array of beam-forming antenna elements, each radiating element having a connector configured to receive a separate RF connector; and a radome shell conformally molded over sides and tops of the radiating elements projecting from radiating surface of the antenna array, the radome shell encapsulating the radiating surface of the antenna array, the radome shell and the antenna array forming an independent unitary structure separable from other components of an antenna assembly, the backside surface of the antenna array not encapsulated by the radome shell; and a radio frequency (RF) shield coupled to the backside surface of the antenna array.

10. The radome of claim 9, wherein the radome shell is over molded around the antenna array.

11. The radome of claim 9, wherein the antenna array is insert molded with the radome shell.

12. The radome of claim 9, wherein the radome shell comprises of a material selected from the group consisting of outdoor grade plastics, glass reinforced plastic and fiberglass.

13. The radome of claim 9, wherein the plurality of radiating elements of the antenna array in an 8×8 array.

14. The radome of claim 9, wherein the radome shell is configured to couple to a chassis and enclose an antenna circuit board therebetween.

15. The radome of claim 9, wherein the antenna array further comprises:

an antenna circuit board coupled to each of the radiating elements by one of the separate RF connectors.

16. The radome of claim 1 further comprising:

a heat sink coupled to the backside surface of the antenna array.

17. The radome of claim 9 further comprising:

a heat sink coupled to the backside surface of the antenna array.

* * * * *